US006467226B2

(12) United States Patent
Dodson et al.

(10) Patent No.: US 6,467,226 B2
(45) Date of Patent: Oct. 22, 2002

(54) WINDOW FRAME, WINDOW FRAME ASSEMBLY AND METHOD OF FABRICATION

(75) Inventors: Gordon Charles Dodson, Lewis Center; Kyozaburo Takagi, Centerville, both of OH (US)

(73) Assignee: Fukuvi USA, Inc., Huber Heights, OH (US)

( * ) Notice: Subject to any disclaimer, the term of this patent is extended or adjusted under 35 U.S.C. 154(b) by 0 days.

(21) Appl. No.: 09/854,909

(22) Filed: May 14, 2001

(65) Prior Publication Data

US 2002/0059758 A1 May 23, 2002

Related U.S. Application Data

(60) Provisional application No. 60/249,801, filed on Nov. 17, 2000.

(51) Int. Cl.[7] ..... E04B 1/52

(52) U.S. Cl. ..... 52/220.1; 52/205; 52/206; 52/207; 52/210; 52/204.1; 52/213; 52/211; 52/215; 52/217

(58) Field of Search ..... 52/211, 212, 217, 52/204.54, 208, 220.1, 455

(56) References Cited

U.S. PATENT DOCUMENTS

| | | | | |
|---|---|---|---|---|
| 3,797,194 A | * | 3/1974 | Ekstein | 52/758 H |
| 6,308,476 B1 | * | 10/2001 | Nakamoto et al. | 52/217 |
| 6,314,691 B1 | * | 11/2001 | Takagi et al. | 52/220.1 |

FOREIGN PATENT DOCUMENTS

| | | |
|---|---|---|
| AT | 388 019 B | 4/1989 |
| FR | 2 495 682 A | 6/1982 |
| GB | 1 216 370 A | 12/1970 |
| GB | 1 417 340 A | 12/1975 |
| GB | 2 111 573 A | 7/1983 |
| NL | 7 509 873 A | 2/1977 |

* cited by examiner

*Primary Examiner*—Carl D. Friedman
*Assistant Examiner*—Basil Katcheves
(74) *Attorney, Agent, or Firm*—Killworth, Gottman, Hagan & Schaeff, L.L.P.

(57) ABSTRACT

An improved window frame is provided. The window frame utilizes one or more locking panels coupled to the frame body via a living hinge. In accordance with one embodiment of the present invention, the window frame includes a plurality of frame segments extending between respective corners of the window frame. Each of the frame segments defines a cross section comprising a frame body including a locking structure catch formed therein, a frame locking structure arranged to engage the locking structure catch, and a locking panel secured to the frame body via a living hinge. The living hinge is arranged to permit the first locking panel to pivot relative to the frame body between a closed state and an open state. The locking panel is arranged to engage the frame body and define a window securing dimension between the frame body and the locking panel upon pivoting to the closed state. The locking panel and the frame body are provided with opposing locking panel catches arranged to secure the locking panel in the closed state. The frame body, the locking panel and the living hinge include a co-extruded unit including the opposing locking panel catches.

46 Claims, 6 Drawing Sheets

WINDOW FRAME, WINDOW FRAME ASSEMBLY AND METHOD OF FABRICATION

CROSS-REFERENCE TO RELATED APPLICATIONS

This application claims the benefit of U.S. provisional application Ser. No. 60/249,801, filed Nov. 17, 2000.

BACKGROUND OF THE INVENTION

The present invention relates to an improved extruded product suitable for use as a window frame. More specifically, the present invention relates to the fabrication of a window frame that may be assembled and installed without the use of adhesives, screws, nuts, bolts or other supplemental mechanical fasteners.

Generally, the process of window frame construction and window installation is a time-consuming endeavor. It is often necessary to use adhesives or a large number of mechanical fasteners to secure the frame to a structure and to secure a window to the frame. As a result, a significant investment of time is required for proper installation. In addition, these types of installations are subject to a significant amount of human error because a certain level of expertise is necessary to use adhesives and supplemental mechanical fasteners.

The challenges associated with window replacement are similar to those associated with window and window frame installation. In addition, it is often difficult and costly to ensure that particular window frame designs permit convenient window replacement. Accordingly, there is a need for an improved window frame design that overcomes these problems and enables convenient installation and replacement.

BRIEF SUMMARY OF THE INVENTION

This need is met by the present invention wherein an improved window frame is provided. The window frame utilizes one or more locking panels coupled to the frame body or locking structure via a living hinge. In accordance with one embodiment of the present invention, a window frame is provided including a plurality of frame segments extending between respective corners of the window frame, wherein each of the frame segments defines a cross section comprising a frame body, a hinge, and a locking panel secured to the frame body via the hinge. The hinge is arranged to permit the first locking panel to pivot relative to the frame body between a closed state and an open state. The locking panel is arranged to engage the frame body and define a window securing dimension between the frame body and the locking panel upon pivoting to the closed state. A locking structure catch is formed in the frame body. Preferably, a frame locking structure is arranged to engage the locking structure catch formed in the frame body and define a structural member securing dimension between the frame locking structure and the frame body upon engagement with the frame body.

In accordance with another embodiment of the present invention, a window frame is provided including a plurality of frame segments extending between respective corners of the window frame. Each of the frame segments defines a cross section comprising a frame body, a locking structure catch formed in the frame body, a frame locking structure, a hinge, and a locking panel. The frame locking structure is arranged to engage the locking structure catch formed in the frame body and define a structural member securing dimension between the frame locking structure and the frame body upon engagement with the frame body. The locking panel is secured to the frame locking structure via the hinge. The hinge is arranged to permit the locking panel to pivot relative to the frame locking structure between a closed state and an open state. The locking panel is arranged to define a window securing dimension between the frame body and the locking panel upon pivoting to the closed state. The locking panel and the frame body may be provided with opposing locking panel catches arranged to secure the locking panel in the closed state. Alternatively, the locking panel and the locking structure may be provided with the opposing locking panel catches.

In accordance with yet another embodiment of the present invention, the window frame includes a plurality of frame segments extending between respective corners of the window frame. Each of the frame segments defines a cross section comprising a frame body, first and second hinges, and first and second locking panels. The first locking panel is secured to the frame body via the first hinge. The first hinge is arranged to permit the first locking panel to pivot relative to the frame body between a closed state and an open state. The first locking panel is also arranged to engage the frame body upon pivoting to the closed state. Similarly, the second locking panel is secured to the frame body via the second hinge. The second hinge is also arranged to permit the second locking panel to pivot relative to the frame body between a closed state and an open state. The second locking panel is also arranged to engage the frame body upon pivoting to the closed state.

The window frame may further comprise first and second compressible members associated with the first and second locking panels and arranged such that movement of the locking panels into a closed state is characterized by compression of the compressible member. Preferably, the compressible member comprises a pliant seal arranged to compress by bending or a pliant surface. The window frame may further comprise an opposing pliant surface arranged on the frame body opposite the pliant seal.

The window frame may further comprise opposing locking panel catches formed on the first and second locking panels and the frame body. The locking panel catches are arranged to secure the first and second locking panels in the closed state. The opposing locking panel catches may be arranged to permit repeatable pivoting of the first and second locking panels between the closed and open states.

The first and second locking panels and the associated hinges may be arranged to pivot in opposite directions and preferably comprise living hinges formed with the locking panels and the frame body. At least one of the first and second hinges may comprise an extended length living hinge arranged to define at least two distinct pivoting axes as one of the first and second panels pivot relative to the frame body.

The frame body, the first and second hinges, and the first and second locking panels may comprise a co-extruded unit where the first and second hinges comprise relatively pliant portions of the cross section and the frame body defines a relatively rigid portion of the cross section. The first and second compressible members and opposing pliant surfaces may also be part of the co-extruded unit and are preferably relatively pliant portions of the cross section.

In accordance with yet another embodiment of the present invention, a window frame is provided including a plurality of frame segments extending between respective corners of the window frame, wherein each of the frame segments defines a cross section comprising a frame body including a locking structure catch formed therein, a frame locking structure arranged to engage the locking structure catch, and a locking panel secured to the frame body via a living hinge. The living hinge is arranged to permit the first locking panel to pivot relative to the frame body between a closed state and an open state. The locking panel is arranged to engage the frame body and define a window securing dimension between the frame body and the locking panel upon pivoting to the closed state. The locking panel and the frame body are provided with opposing locking panel catches arranged to secure the locking panel in the closed state. The frame body, the locking panel and the living hinge comprise a co-extruded unit including the opposing locking panel catches.

In accordance with yet another embodiment of the present invention, a window frame is provided including a plurality of frame segments extending between respective corners of the window frame, wherein each of the frame segments defines a cross section comprising a frame body including a locking structure catch formed therein, a frame locking structure arranged to engage the locking structure catch, and a locking panel secured to the frame locking structure via a living hinge. The living hinge is arranged to permit the first locking panel to pivot relative to the frame locking structure between a closed state and an open state. The locking panel is arranged to engage the frame locking structure and define a window securing dimension between the frame body and the locking panel upon pivoting to the closed state. The locking panel and the frame locking structure are provided with opposing locking panel catches arranged to secure the locking panel in the closed state. The frame locking structure, the locking panel and the living hinge comprise a co-extruded unit including the opposing locking panel catches.

In accordance with yet another embodiment of the present invention, a window frame assembly is provided. The assembly comprises a structural member, a window, and a window frame. The structural member may be a garage door and defines an interior side, an exterior side, and an opening. The window also defines an exterior side and an interior side. The window frame secures the window over the opening and includes a plurality of frame segments extending between respective corners of the window frame.

In accordance with yet another embodiment of the present invention, an extruded strip suitable for fabrication of a window frame is provided. The extruded strip includes a plurality of frame segments extending between respective corners of the window frame and defines a selected one of the cross sections according to the present invention.

In accordance with yet another embodiment of the present invention, a method of fabricating a window frame from an extruded strip of material is provided. The method comprises the steps of generating a co-extrusion defining a cross section including relatively pliant portions and relatively rigid portions. Portions of the extrusion are removed to permit fabrication of a window frame including a plurality of frame segments extending between respective corners of the window frame. Respective positions of the corners within the window frame are defined by respective positions of the removed portions along the extrusion. The extrusion is then folded at the respective positions of the removed portions to form the respective corners. The abutting portions of the folded extrusion are then bonded at the respective corners.

Accordingly, it is an object of the present invention to provide an improved window frame. Other objects of the present invention will be apparent in light of the description of the invention embodied herein.

BRIEF DESCRIPTION OF THE SEVERAL VIEWS OF THE DRAWINGS

The following detailed description of the preferred embodiments of the present invention can be best understood when read in conjunction with the following drawings, where like structure is indicated with like reference numerals and in which.

DETAILED DESCRIPTION

Figure 1:
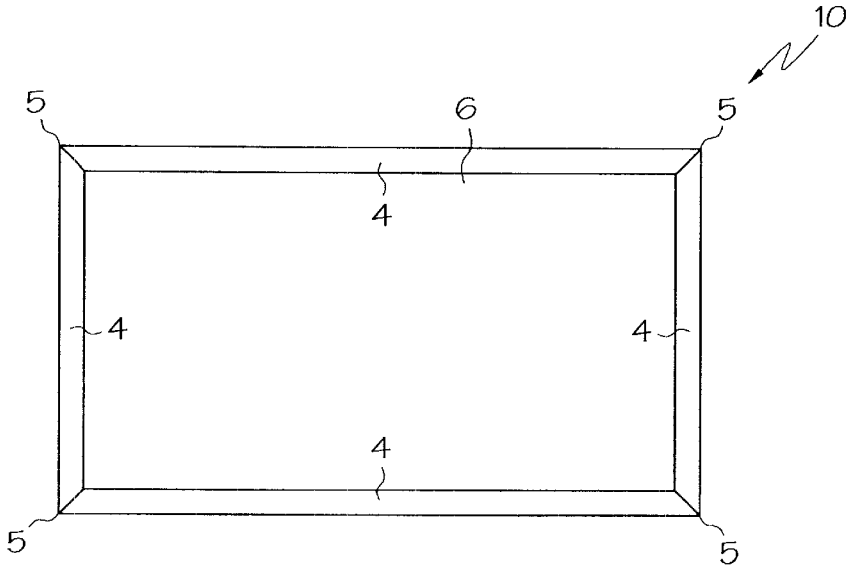
FIG. 1 is a plan view of a window frame according to one embodiment of the present invention.
Figure 2:
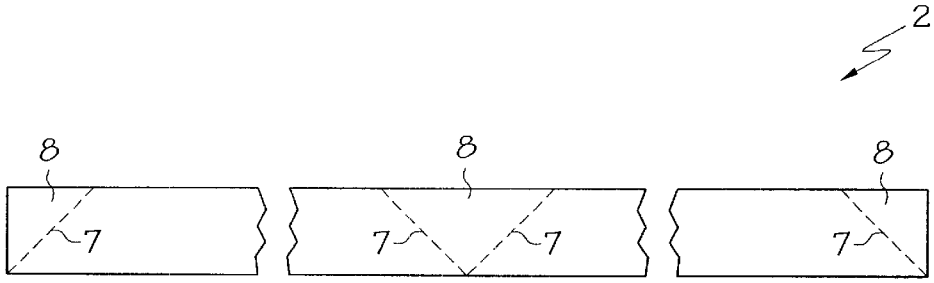
FIG. 2 is a plan view of an un-folded and un-cut extruded product used to form the window frame of the present invention.

Referring initially to FIGS. 1 and 2, a window frame 10 according to the present invention may be formed from an extruded strip 2. The window frame 10 includes a plurality of frame segments 4 extending between respective corners 5 of the window frame 10 defining a frame opening 6 in the window frame 10. A plurality of 45° cut lines 7 are formed in the extruded strip 2 to enable removal of portions 8 of the strip 2 and subsequent bending or folding of the strip 2 into the orientation of a rectangular window frame 10. It is important to note that a portion of the cross section of the strip 2 is left un-cut to preserve joinder of the frame segments 4 along the outside edges of the corners 5. It is contemplated that, although rectangular window frame arrangements are illustrated in the figures, a number of alternative geometrical frame arrangements may be constructed according to the present invention. It is further contemplated that the extrusion strip 2 may be cut in a variety of alternative ways to define the frame segments 4 extending between respective corners 5 of the window frame 10.

Figure 3A:
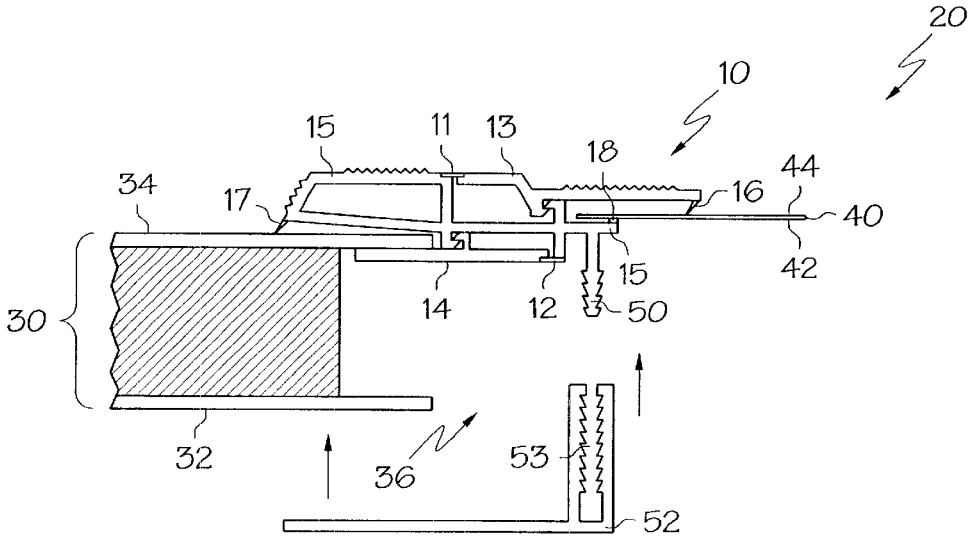
FIG. 3A is a cross sectional view of a window frame assembly according to the present invention with locking panels in a closed state.

Referring now to FIG. 3A, a window frame assembly 20 according to one embodiment of the present invention is illustrated. The assembly 20 includes a structural member 30, a window 40, and the window frame 10. The structural member 30, which may for example be a garage door, typically defines an interior side 32, an exterior side 34, and an opening 36. Similarly, the window 40 defines an interior side 42 and an exterior side 44.

The window frame 10 secures the window 40 over the opening 36. The window 40, typically a glass or transparent plastic plate, serves as a sealed partition between the interior and exterior sides 32, 34 of the structural member 30. Each of the segments 4 of the window frame 10 defines a cross section comprising a frame body 15, a first hinge 11, a second hinge 12, and first and second locking panels 13, 14.

Figure 3B:
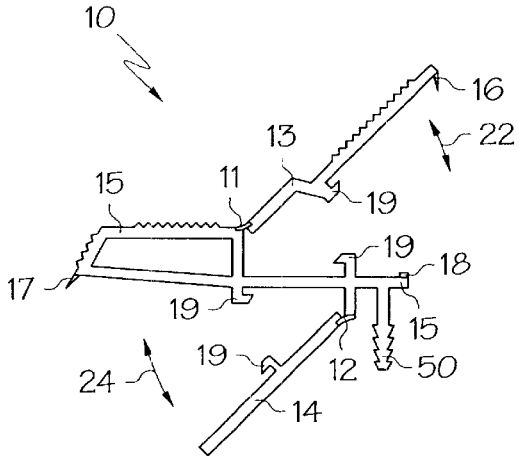
FIG. 3B a cross sectional view of the window frame of FIG. 3A with locking panels in an open state.

The first locking panel 13 is secured to the frame body 15 via the first hinge 11. The first hinge 11 is arranged to permit the first locking panel 13 to pivot relative to the frame body 15 between a closed state and an open state, as indicated by directional arrow 22. FIG. 3A illustrates the first locking panel 13 in the closed state and FIG. 3B illustrates the first locking panel 13 in the open state. As is clearly illustrated in FIG. 3A, the closed state is characterized by engagement of the exterior side 44 of the window 40 with the first locking panel 13 and engagement of the interior side 42 of the window 40 with the frame body 15.

The second locking panel 14 is secured to the frame body 15 via the second hinge 12. The second hinge 12 is arranged to permit the second locking panel 14 to pivot relative to the frame body 15 between a closed state and an open state, as indicated by directional arrow 24. As is clearly illustrated in FIG. 3A, the closed state is characterized by engagement of the exterior side 34 of the structural member 30 with the frame body 15 and engagement of the interior side 32 of the structural member 30 with the second locking panel 14.

The first and second locking panels 13, 14 and the associated hinges 11, 12 are arranged to pivot in opposite directions. Thus, the window 40 may be installed in the window frame 10 by opening the first locking panel 13 associated with each frame segment 4, placing the window 40 within the frame body 15 over the frame opening 7, and closing each of the first locking panels 13. The frame may be installed on the structural member 30 by opening the second locking panel 14 associated with each frame segment 4, placing the window frame along the inside edges of the window opening 36, and closing each of the second locking panels 14. Reference is made below to a frame locking structure 52 which may be employed to further secure the frame 10 to the structural member 30.

FIGS. 3A and 3B further illustrate that the first locking panel 13 and the second locking panel 14 are arranged to engage the frame body 15 upon pivoting to their respective closed states. More specifically, the frame 10 further comprises opposing locking panel catches 19 formed on the first and second locking panels 13, 14 and on the frame body 15. The locking panel catches 19 are arranged to secure the first and second locking panels 13, 14 in the respective closed states. The opposing locking panel catches 19 are preferably formed from relatively rigid material but their structural configuration, illustrated in FIGS. 3A and 3B, allows for forcible disengagement of the opposing catches and, as such, are arranged to permit repeatable pivoting of the first and second locking panels 13, 14 between the closed and open states.

First and second compressible members 16, 17 and opposing pliant surfaces 18 may be provided to improve the seal between the exterior and interior sides 32, 34 of the structural member 30 and to provide for more secure engagement of the window 40 and structural member 30 by the window frame 10. For example, referring again to FIGS. 3A and 3B, a first compressible member in the form of a pliant seal 16 is formed on the first locking panel 13 and is arranged such that movement of the first locking panel 13 into a closed state causes the pliant seal 16 to engage the window 40 and bend to create a securely sealed interface. The force of the engagement of the window 40 and the pliant seal 16 also causes a degree of compression in the opposing pliant surface 18. This forcible compression of the pliant seal 16 and the opposing pliant surface 18 creates a securely sealed interface on the window 40. Similarly, a second compressible member associated with the second locking panel 14 in the form of a pliant seal 17 is formed on the frame body 15 and is arranged such that movement of the second locking panel 13 into a closed state causes the pliant seal 17 to engage the structural member 40 and bend to create a securely sealed interface.

Preferably, the frame body 15, the first and second hinges 11, 12, and the first and second locking panels 13, 14 comprise a co-extruded unit where the first and second hinges 11, 12 comprise relatively pliant portions of the cross section and the locking panels 13, 14 and the frame body 15 define relatively rigid portions of the cross section. In this manner, the first and second hinges 11, 12 comprise living hinges formed with the locking panels 13, 14 and the frame body 15. Preferably, the opposing pliant surfaces 18 are also part of the co-extrusion and comprise relatively pliant portions of the cross section. For the purposes of defining and describing the present invention, it is noted that a living hinge may be bent multiple times without breakage or fracture of the hinge material. Living hinges may be formed from soft, flexible thermoplastic elastomers that exhibit high endurance to flexural fatigue.

The window frame assembly 20 of the present invention may further include a locking structure catch 50 formed in the frame body 15 and a frame locking structure 52 arranged to engage the locking structure catch 50 and define a structural member securing dimension between the frame locking structure 52 and the frame body 15 upon engagement with the locking structure catch 50 formed in frame body 15. As is clearly illustrated in FIG. 3A, the frame locking structure 52 includes a locking channel 53 arranged to engage progressively the locking structure catch 50 formed in the frame body 15.

Figure 4:
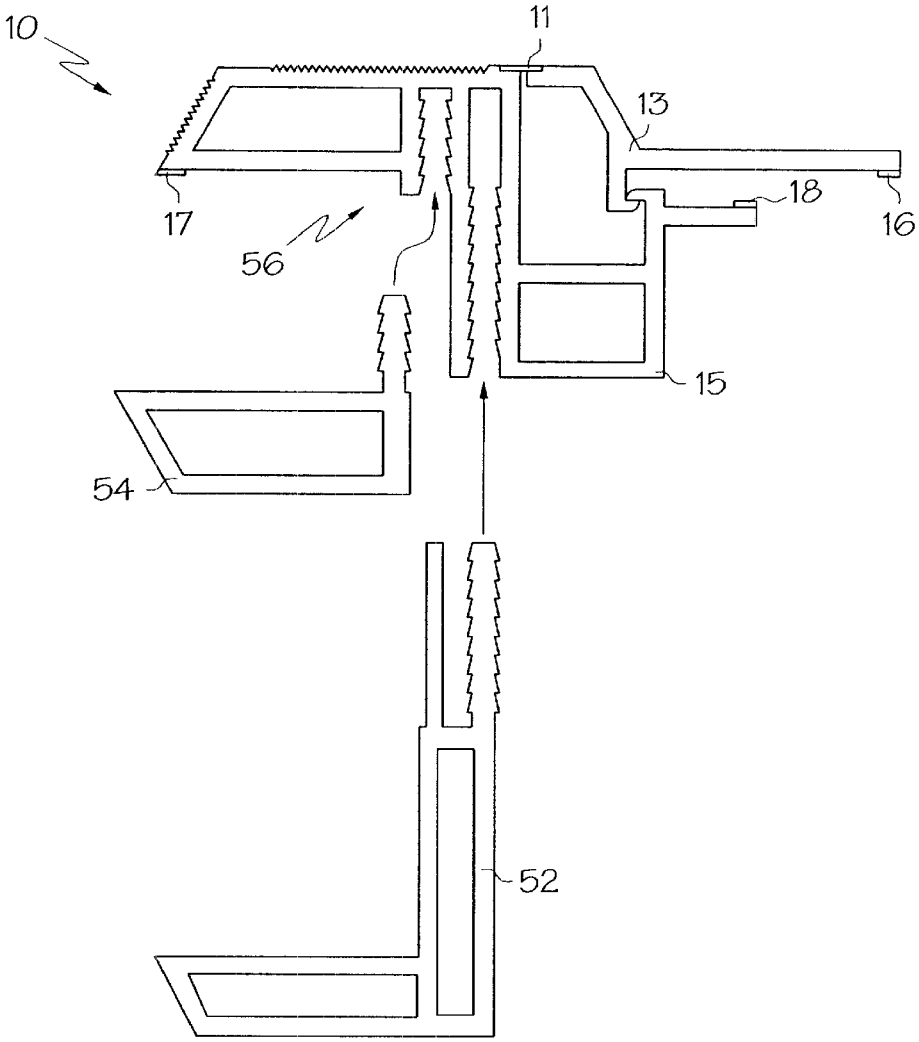
FIGS. 4–11 are cross sectional views of some alternative window frames according to the present invention.

The frame body 15 defines an exterior side 15A and an interior side 15B and the locking structure catch 50 is arranged on the interior side 15B of the frame body 15. The first hinge 11 and the first locking panel 13 are arranged on the exterior side 15A of the frame body 15 and the second hinge 12 and the second locking panel 14 are arranged on the interior side 15B of the frame body 15. FIG. 4 illustrates a similar arrangement.

FIGS. 4–11 illustrate alternative embodiments of the present invention. Each of these figures illustrates the invention merely by illustrating the cross section of an extruded strip or segment of the window frame 10. To preserve clarity in FIGS. 4–11, no reference is made to a window or structural member. The arrangement of the structural member and window may be gleaned from the illustration of the present invention in FIG. 3A. In each of the illustrated embodiments, the frame body 15 defines an exterior side 15A and an interior side 15B.

In the embodiment of the present invention illustrated in FIG. 4, the second locking panel 14 of FIGS. 3A and 3B is not utilized. Rather, a supplemental frame locking structure 54 and a supplemental locking structure catch 56 are provided in place of the second locking panel 14 and the opposing catches 19 of the FIG. 3A embodiment. Together, the supplemental frame locking structure 54 and the frame locking structure 52 provide for the securely sealed interface between the second compressible member 17 and the structural member.

Figure 5:
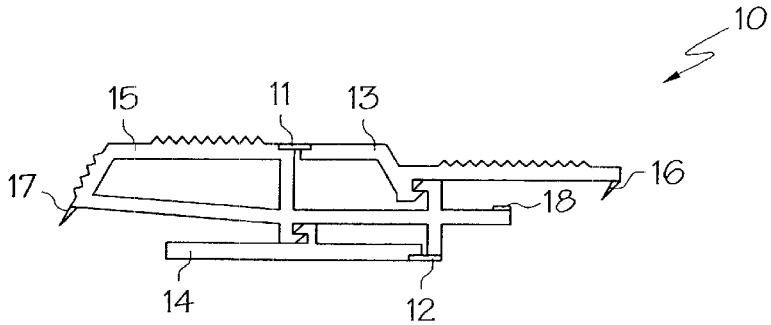
Figure 6:
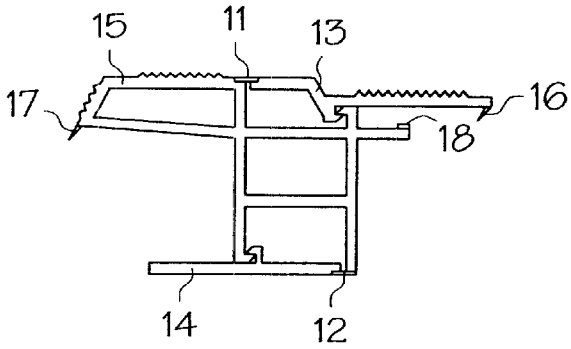
Figure 7:
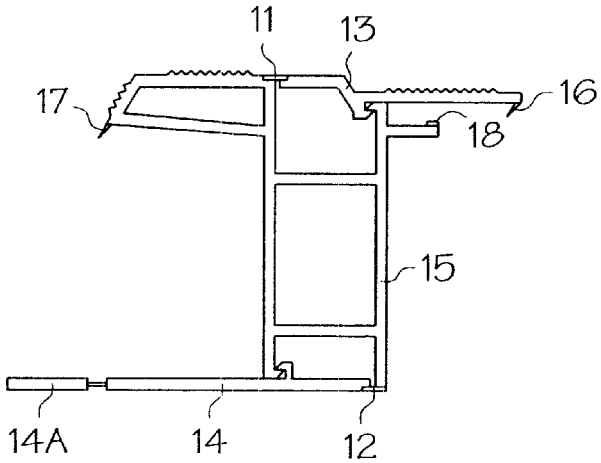

In the embodiment of the present invention illustrated in FIG. 5, the frame locking structure 52 illustrated in FIGS. 3A, 3B, and 4 is not utilized. Rather, securement of the window frame 10 to the structural member is achieved solely by closing the second locking panel 14 against the structural member in the manner illustrated above with reference to FIGS. 3A and 3B. The embodiment of FIG. 6 is similar to that illustrated in FIG. 5, with the exception that the frame body 15 is expanded to create a larger spacing between the closed second locking panel 14 and the second compressible member or pliant seal 17. In this manner, the window frame 10 of FIG. 6 can be secured to structural members of greater thickness, as compared to the window frame illustrated in FIG. 5. The window frame 10 of FIG. 7 includes a frame body 15 that is expanded even further than the frame body 15 of FIG. 6. The window frame 10 of FIG. 7 also includes a second locking panel 14 that includes an extended portion 14A. The extended portion 14A is provided to help cover relatively large gaps that may be present between the structural member and the frame body 15.

Figure 8:
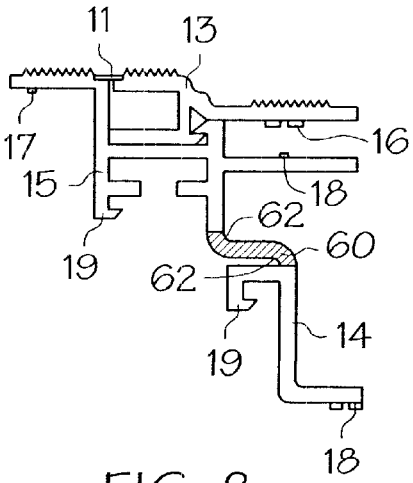

Turning now to FIG. 8, the window frame 10 of this embodiment includes an extended length living hinge 60 arranged to define at least two distinct pivoting axes 62 as the second locking panel 14 pivots relative to the frame body 15. An extended length living hinge may also be provided in place of the first hinge 11. In either case, the extended length living hinge is advantageous because it provides for more manageable installation of the window frame 10. Specifically, in certain circumstances, it may be difficult to open and close locking panels associated with adjacent segments of the window frame 10 because the locking panels may inadvertently abut or overlap each other as one or both of the panels are opened and closed. The extended length living hinge allows for greater freedom of movement in the hinge at issue, enabling a user to position a particular locking panel clear of an adjacent locking panel by pivoting the hinge about both of the distinct pivoting axes 62. The extended length living hinge 60 also allows for additional mechanical play when a locking panel including the hinge 60 is positioned in the closed state.

Figure 9:
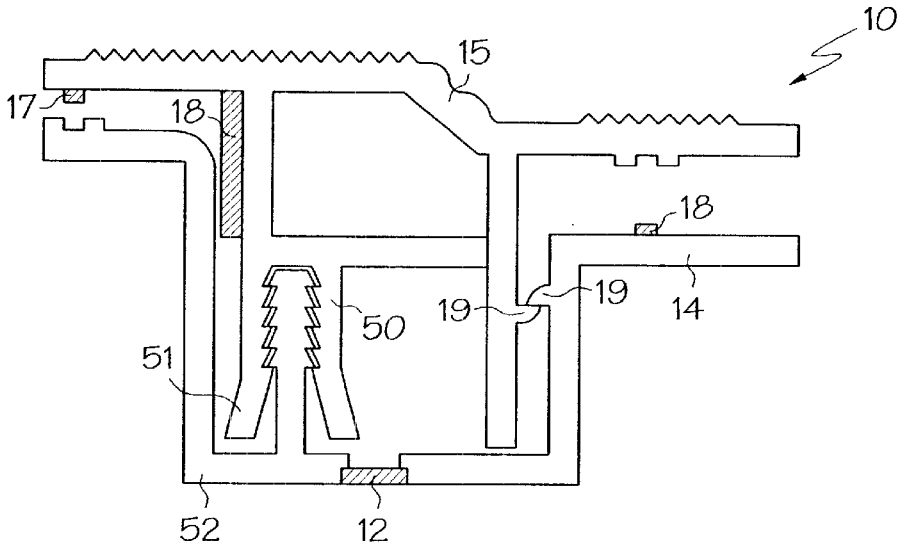

In the embodiment of FIG. 9, a frame locking structure 52 and locking structure catch 50 are also provided. The frame locking structure 52 is arranged to engage the locking structure catch 50 formed in the frame body 15. The locking structure catch 50 is provided with a flared opening portion 51 to make it easier to engage the locking structure 52 and locking structure catch 50 properly. Also, in the FIG. 9 embodiment, it is important to note that the locking structure 52 is fabricated to include the second locking panel 14 secured thereto via the second hinge 12. Further, the second locking panel 14 and the frame body 15 are provided with opposing locking panel catches 19 arranged to secure the second locking panel 14 in the closed state. The first locking panel 13 illustrated in other embodiments of the present invention is not provided in the FIG. 9 embodiment.

Figure 10:
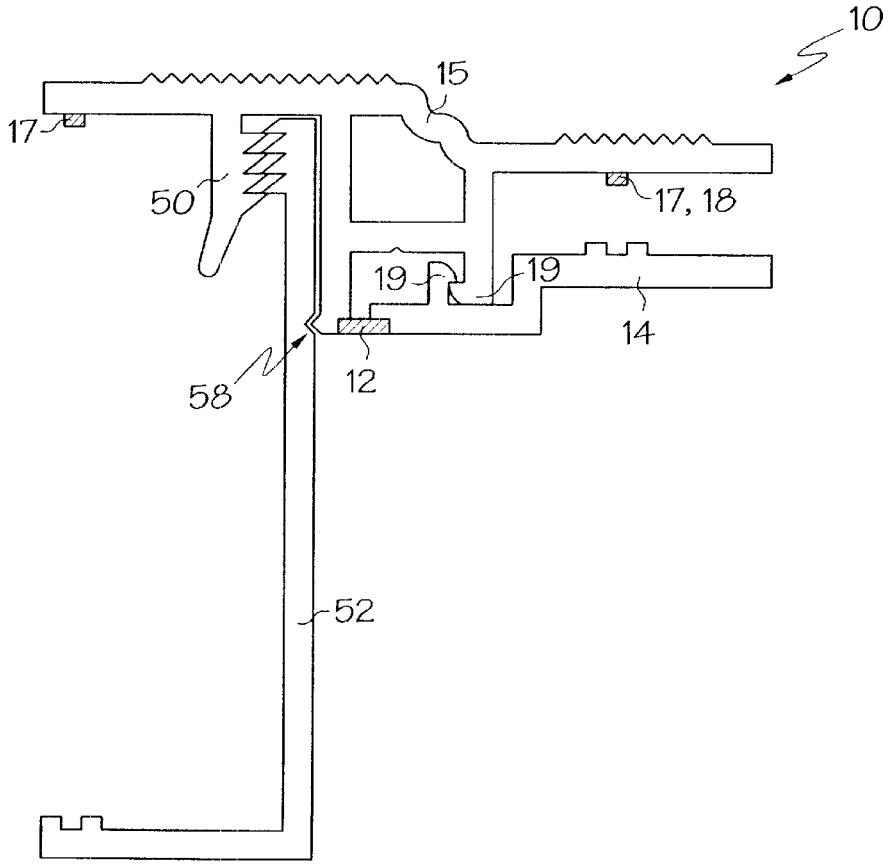

In the embodiment of FIG. 10, a frame locking structure 52 and locking structure catch 50 are also provided. The first locking panel 13 illustrated in other embodiments is excluded. However, unlike the FIG. 9 arrangement, the second locking panel 14 is not secured to the locking structure 52. Rather, the second locking panel 14 is secured to the frame body 15 via the hinge 12. The locking panel 14 and the frame body 15 are provided with the opposing locking panel catches 19. In this manner, each of the opposing locking panel catches 19 may be formed as part of the same extruded strip of material, allowing for improved accuracy and precision in production of the window frame 10.

In FIG. 10, the frame locking structure 52 and the frame body 15 further define complementary nesting seams 58 therein to further support and secure the locking structure 52 in an engaged relationship with the locking structure catch 50. In the illustrated embodiment, the complementary nesting seams 58 comprise a projected seam formed on the frame body 15 and a recessed seam formed on the locking structure 52.

Figure 11:
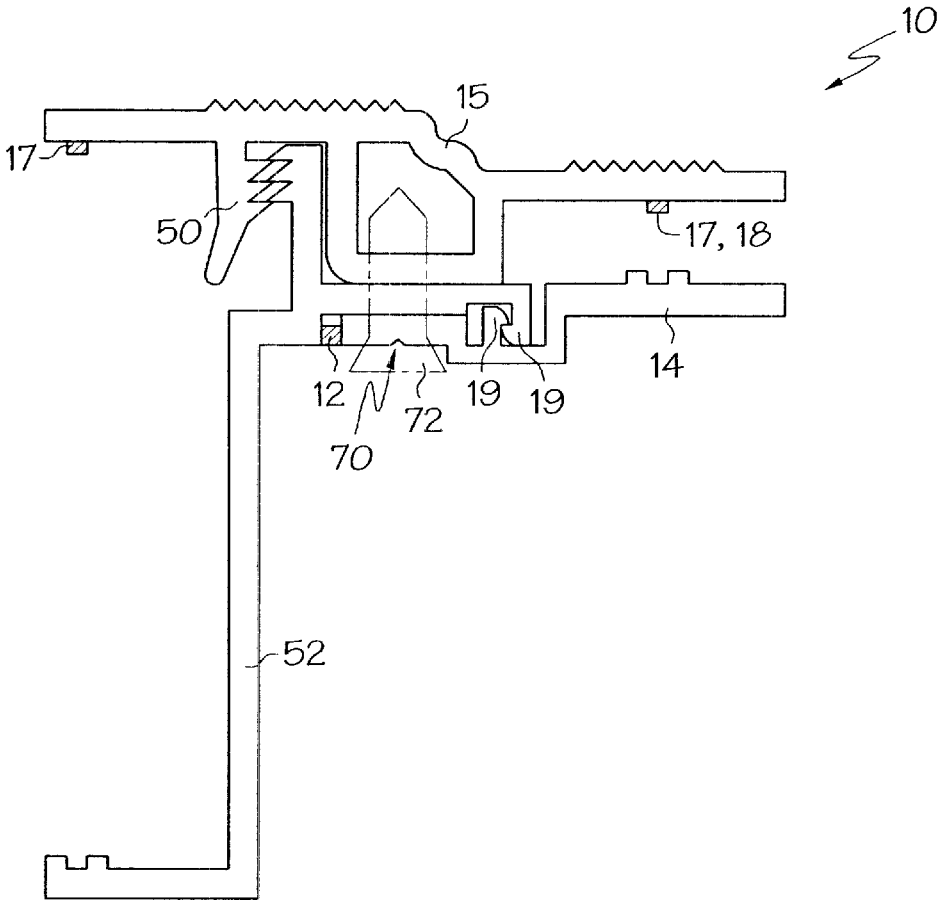

The window frame 10 illustrated in the embodiment of FIG. 11, differs from that illustrated in FIG. 10 in that the locking panel 14 is secured to the frame locking structure 52. Further, the locking panel 14 and the locking structure 52 are provided with opposing locking panel catches 19 arranged to secure the locking panel 14 in the closed state. In this manner, each of the opposing locking panel catches 19 may also be formed as part of the same extruded strip of material. The locking panel 14 is provided with at least one screw score 70 to enable convenient installation of a support screw 72 in the event supplemental securement of the window frame is required or desired. to As is noted above, the window frame according to the present invention may be fabricated from an extruded strip of material by generating a co-extrusion defining a cross section including relatively pliant portions and relatively rigid portions. Typically, the frame body, the first and second locking panels, the locking structure, and the catches described above are the relatively rigid portions while the first and second hinges, the pliant seals, and the opposing pliant surfaces are the relatively pliant portions. Portions of an extruded strip are removed (see ref. #8 in FIG. 2) to permit fabrication of a window frame including a plurality of frame segments extending between respective corners of the window frame. The respective positions of the corners within the window frame are defined by the respective positions of the removed portions along the extrusion. The extrusion is then folded at the removed portions to form the corners and abutting portions of the folded extrusion are bonded at the respective corners by applying a conventional bonding solution along the abutting portions. Almost any rigid or semirigid plastic material may be used in the production of the described window frame. Preferred materials include solid or foamed polyvinyl chloride, polyethylene, low density or high density polypropylene, acrylics, and polycarbonate.

Having described the invention in detail and by reference to preferred embodiments thereof, it will be apparent that modifications and variations are possible without departing from the scope of the invention defined in the appended claims. More specifically, although some aspects of the present invention are identified herein as preferred or particularly advantageous, it is contemplated that the present invention is not necessarily limited to these preferred aspects of the invention.

What is claimed is:

1. A window fame including a plurality of frame segments extending between respective corners of said window frame, wherein each of said frame segments defines a cross section comprising:

a frame body, a hinge;

a locking panel secured to said frame body via said hinge, wherein said hinge is arranged to permit said first locking panel to pivot relative to said frame body between a closed state and an open state, said locking panel is arranged to engage said frame body and define a window securing dimension between said frame body and said locking panel upon pivoting to said closed state; and a locking structure catch formed in said frame body.

2. A window frame as claimed in claim 1 further comprising a frame locking structure arranged to engage said locking structure catch formed in said frame body ad define a structural member securing dimension between said frame locking structure and said frame body upon engagement with said frame body.

3. A window frame as claimed in claim 2 wherein said locking panel and said frame body are provided with opposing locking panel catches arranged to secure said locking panel in said closed state.

4. A window frame as claimed in claim 2 wherein said fame locking structure includes a locking projection arranged to engage progressively a locking channel including a plurality of locking structure catches formed in said frame body.

5. A window frame as claimed in claim 2 wherein said frame locking structure and said frame body further define complementary nesting seams therein and wherein said nesting seams are arranged to secure said locking structure to said frame body.

6. A window frame as claimed in claim 5 wherein said complementary nesting seams comprise a projected seam formed on said frame body and a recessed seam formed on said locking structure.

7. A window frame as claimed in claim 2 further comprising a supplementary locking structure arranged to engage a supplementary locking structure catch formed in said frame body and define a supplemental structure member securing dimension between said frame locking structure and said frame body upon engagement with said frame body, wherein said supplemental structural member securing dimension is smaller than said structural member securing dimension.

8. A window frame as claimed in claim 2 wherein said frame locking structure and said locking structure catch are arranged to allow contraction of said structural member securing dimension.

9. A window frame as claimed in claim 2 wherein:

said frame body defines an exterior side and an interior side;

said locking structure catch is arranged on said interior side of said frame body; and said hinge and said locking panel are arranged on said exterior side of said frame body.

10. A window frame as claimed in claim 2 wherein:

said frame body defines an exterior side and an interior side;

said locking structure catch is arranged on said interior side of said frame body; and said hinge and said locking panel are arranged on said interior side of said frame body.

11. A window frame as claimed in claim 2 wherein said locking structure catch is provided with a flared opening portion.

12. A window frame as claimed in claim 2 wherein said locking panel is provided with at least one screw score.

13. A window frame as claimed in claim 1 wherein said frame body further comprises first and second compressible members positioned to provide a seal between said window frame assembly and a structural member and window engaged by said frame body.

14. A window frame as claimed in claim 13 wherein said frame body further comprises pliant surfaces arranged to oppose said compressible members.

15. A window frame as claimed in claim 1 wherein said hinge comprises a living hinge formed with said locking panel and said frame body.

16. A window frame as claimed in claim 15 wherein said hinge comprises an extended length living hinge arranged to define at least two distinct pivoting axes as one of said first and second panels pivot relative to said frame body.

17. A window frame as claimed in claim 1 wherein said frame body, said hinge, and said locking panel comprise a co-extruded unit.

18. A window frame as claimed in claim 1 wherein said hinges comprises a relatively pliant portion of said cross section and said frame body and said locking panel define relatively rigid portions of said cross section.

19. A window frame including a plurality of frame segments extending between respective corners of said window frame, wherein each of said frame segments defines a cross section comprising:

a frame body, a locking structure catch formed in said frame body;

a frame locking structure arranged to engage said locking structure catch formed in said frame body and define a structural member securing dimension between said frame locking structure and said frame body upon engagement with said frame body;

a hinge; and a locking panel secured to said frame locking structure via said hinge, wherein said hinge is arranged to permit said locking panel to pivot relative to said frame locking structure between a closed state and an open state, said locking panel is arranged to define a window securing dimension between said frame body and said locking panel upon pivoting to said closed state.

20. A window frame as claimed in claim 19 wherein said locking panel is arranged to engage said frame body.

21. A window frame as claimed in claim 20 wherein said locking panel and said frame body are provided with opposing locking panel catches arranged to secure said locking panel in said closed state.

22. A window frame as claimed in claim 19 wherein said locking panel is arranged to engage said locking structure.

23. A window frame as claimed in claim 22 wherein said locking panel and said locking structure are provided with opposing locking panel catches arranged to secure said locking panel in said closed state.

24. A window assembly comprising:

a window, having an exterior side and an interior side; and a frame including a plurality of frame segments extending between respective corners of said window frame, wherein each of said frame segments defines a cross section comprising:

a frame body;

a first hinge;

a second hinge;

a first locking panel secured to said frame body via said first hinge, wherein said fist hinge is arranged to permit said first locking panel to pivot relative to said frame body between a closed state and an open state, and said first locking panel is arranged to engage said frame body upon pivoting to said closed state; and a second locking panel secured to said frame body via said second hinge wherein said second hinge is arranged to permit said second locking panel to pivot relative to said frame body between a closed state and an open state, and said second locking panel is arranged to engage said frame body upon pivoting to said closed state; and a first compressible member associated with said first locking panel and arranged such that movement of said first locking panel into a closed state is characterized by compression of said first compressible member against said exterior side of said window.

25. A window assembly as claimed in claim 24 further comprising a second compressible member associated with said second locking panel and arranged such that movement of said second locking panel into a closed state is characterized by compression of said second compressible member.

26. A window assembly as claimed in claim 24 wherein said fist compressible member comprises a pliant seal arranged to compress by bending.

27. A window assembly as claimed in claim 26 further comprising an opposing pliant surface arranged on said frame body opposite said pliant seal.

28. A window assembly as claimed in claim 25 wherein said second compressible member comprises a pliant seal arranged to compress by bending.

29. A window assembly as claimed in claim 24 further comprising opposing locking panel catches formed on said first and second locking panels and said frame body, wherein said locking panel catches are arranged to secure said first and second locking panels in said closed state.

30. A window assembly as claimed in claim 29 wherein said opposing locking panel catches are further arranged to permit repeatable pivoting of said first and second locking panels between said closed and open states.

31. A window assembly as claimed in claim 24 wherein said first and second locking panels and said associated hinges are arranged to pivot in opposite directions.

32. A window assembly as claimed in claim 24 wherein said first and second hinges comprise living hinges formed with said locking panels and said frame body.

33. A window assembly as claimed in claim 32 wherein at least one of said first and second hinges comprise an extended length living hinge arranged to define at least two distinct pivoting axes as one of said first and second panels pivot relative to said frame body.

34. A window assembly as claimed in claim 24 wherein said frame body, said first and second hinges, and said first and second locking panels comprise a co-extruded unit.

35. A window frame as claimed in claim 24 wherein said first and second hinges comprise relatively pliant portions of said cross section and said frame body defines a relatively rigid portion of said cross section.

36. A window assembly as claimed in claim 25 further comprising respective opposing pliant surfaces arranged on said frame body opposite said first and second compressible members.

37. A window assembly as claimed in claim 36 wherein said frame body, said first and second hinges, said first and second locking panels, said first and second compressible members, and said opposing pliant surfaces comprise a co-extruded unit.

38. A window assembly as claimed in claim 36 wherein said first and second binges, said first and second compressible members, and said opposing pliant surfaces comprise relatively pliant portions of said cross section and said frame body defines a relatively rigid portion of said cross section.

39. A window assembly as claimed in claim 24 wherein said window frame further includes a locking structure catch formed in said frame body and a frame locking structure arranged to engage said locking structure catch and define a structural member securing dimension between said frame locking structure and said frame body upon engagement with said frame body.

40. A window frame including a plurality of frame segments extending between respective corners of said window frame, wherein each of said frame segments defines a cross section comprising:

a frame body including a locking structure catch formed therein;

a frame locking structure arranged to engage said locking structure catch;

a locking panel secured to said frame body via a living hinge, wherein said living hinge is arranged to permit said first locking panel to pivot relative to said frame body between a closed state and an open state, said locking panel is arranged to engage said frame body and define a window securing dimension between said frame body and said locking panel upon pivoting to said closed state, said locking panel and said frame body are provided with opposing locking panel catches arranged to secure said locking panel in said closed state, and said flame body, said locking panel and said living hinge comprise a co-extruded unit including said opposing locking panel catches.

41. A window frame including a plurality of frame segments extending between respective corners of said window frame, wherein each of said frame segments defines a cross section comprising:

a frame body including a locking structure catch formed therein;

a frame locking structure arranged to engage said locking structure catch;

a locking panel secured to said frame locking structure via a living hinge, wherein said living hinge is arranged to permit said first locking panel to pivot relative to said frame locking structure between a closed state and an open state, said locking panel is arranged to engage said frame locking structure and define a window securing dimension between said frame body and said locking panel upon pivoting to said closed state, said locking panel and said frame locking structure are provided with opposing locking panel catches arranged to secure said locking panel in said closed state, and said frame locking structure, said locking panel and said living hinge comprise a co-extruded unit including said opposing locking panel catches.

42. A window frame assembly comprising:

a structural member defining an interior side, an exterior side, and an opening;

a window defining an exterior side and an interior side; and a window frame for securing said window over said opening, wherein said window frame includes a plurality of frame segments extending between respective corners of said window frame, and wherein each of said frame segments defines a cross section comprising a frame body including a locking structure catch formed therein;

a frame locking structure arranged to engage said locking structure catch;

a locking panel secured to said frame body via a living hinge, wherein said living hinge is arranged to permit said first locking panel to pivot relative to said frame body between a closed state and an open state, said locking panel is arranged to engage said frame body and define a window securing dimension between said frame body and said locking panel upon pivoting to said closed state, said locking panel and said frame body are provided with opposing locking panel catches arranged to secure said locking panel in said closed state, and said frame body, said locking panel and said living hinge comprise a co-extruded unit including said opposing locking panel catches.

43. A window frame assembly as claimed in claim 42 wherein said structural member comprises a garage door.

44. A window assembly comprising:

a transparent window having an exterior side and an interior side;

a frame, wherein said frame comprises a plurality of frame segments extending between respective corners of said frame, wherein each of said frame segments defines a cross section comprising:

a frame body, a fist hinge;

a second hinge;

a first locking panel secured to said frame body via said first hinge, wherein said first hinge is arranged to permit said first locking panel to pivot relative to said frame body between a closed state and an open state, and said first locking panel is arranged to engage said frame body upon pivoting to said closed state; and a second locking panel secured to said frame body via said second hinge, wherein said second hinge is arranged to permit sad second locking panel to pivot relative to said frame body between a closed state and an open state, and said second locking panel is arranged to engage said frame body upon pivoting to said closed state.

45. A door assembly comprising:

a door;

a window;

a window frame affixing said window to said door, said window frame including a plurality of frame segments extending between respective corners of said window frame, wherein each of said frame segments defines a cross section comprising:

a frame body;

a hinge;

a locking panel secured to said frame body via said hinge, wherein said hinge is arranged to permit said first locking panel to pivot relative to said frame body between a closed state and an open state;

said locking panel is arranged to engage said frame body and define a window securing dimension between said frame body and said locking panel upon pivoting to said closed state; and a locking sure catch formed in said frame body.

46. A door assembly comprising:

a door;

a window having an exterior side and an interior side;

a window frame affixing said window to said door, said frame including a plurality of frame segments extending between respective corners of said window frame, wherein each of said frame segments defines a cross section comprising:

a frame body;

a first hinge, a second hinge;

a first locking panel secured to said frame body via said first hinge, wherein said first binge is arranged to permit said first locking panel to pivot relative to said frame body between a closed state and an open state, and said first locking panel is arranged to engage said frame body upon pivoting to said closed state;

a second locking panel secured to said frame body via said second hinge, wherein said second hinge is arranged to permit said second locking panel to pivot relative to said frame body between a closed state and an open state, and said second locking panel is arranged to engage said frame body upon pivoting to said closed state; and a first compressible member associated with said first locking panel and arranged such that movement of said first locking panel into a closed state is characterized by compression of said first compressible member against said exterior side of said window.

* * * * *